US005877745A

United States Patent [19]

Beeteson et al.

[11] Patent Number: 5,877,745

[45] Date of Patent: Mar. 2, 1999

[54] DATA PROCESSING SYSTEM HAVING A WIRELESS COMMUNICATION LINK FOR DATA COMMUNICATION WITH A PERIPHERAL DEVICE

[75] Inventors: John Beeteson, Skelmorlie; Shaun Kerigan, Kilmalcolm, both of England

[73] Assignee: International Business Machines Corporation, Armonk, N.Y.

[21] Appl. No.: 432,736

[22] Filed: May 2, 1995

[30] Foreign Application Priority Data

Jul. 15, 1994 [GB] United Kingdom ..... 9414361

[51] Int. Cl.[6] ..... G09G 5/00

[52] U.S. Cl. ..... 345/156; 345/2

[58] Field of Search ..... 345/156, 163, 345/168, 169, 157, 1, 2, 3, 10, 11; 340/825.31, 825.32, 825.36; 364/707; 395/893, 894, 882

[56] References Cited

U.S. PATENT DOCUMENTS

| | | | |
|---|---|---|---|
| 4,259,594 | 3/1981 | Fox et al. | 364/707 |
| 4,337,480 | 6/1982 | Bourassin | 345/2 |
| 4,365,290 | 12/1982 | Nelms et al. | 364/707 |
| 4,939,509 | 7/1990 | Bartholomew et al. | 345/2 |
| 5,079,628 | 1/1992 | Tomikawa . | |
| 5,110,226 | 5/1992 | Sherman et al. | 364/707 |
| 5,111,185 | 5/1992 | Kozaki | 340/825.31 |
| 5,257,390 | 10/1993 | Asprey | 395/281 |
| 5,270,821 | 12/1993 | Samuels | 345/156 |
| 5,276,458 | 1/1994 | Sawdon | 345/132 |
| 5,307,297 | 4/1994 | Iguchi et al. | 345/169 |
| 5,309,556 | 5/1994 | Sismilich | 345/349 |
| 5,315,695 | 5/1994 | Saito et al. | 345/12 |
| 5,347,630 | 9/1994 | Ishizawa et al. | 345/509 |
| 5,406,624 | 4/1995 | Tulpan | 380/4 |
| 5,428,806 | 6/1995 | Pocrass | 395/284 |
| 5,475,473 | 12/1995 | Arai et al. | 345/10 |
| 5,490,287 | 2/1996 | Itoh et al. | 455/69 |
| 5,504,475 | 4/1996 | Houdou et al. | 340/825.36 |
| 5,515,051 | 5/1996 | Tanaka et al. | 345/168 |
| 5,532,719 | 7/1996 | Kikinis | 345/212 |
| 5,550,556 | 8/1996 | Wu et al. | 345/12 |
| 5,552,776 | 9/1996 | Wade et al. | 340/825.31 |
| 5,570,108 | 10/1996 | McLaughlin et al. | 345/146 |
| 5,570,297 | 10/1996 | Brzezinski et al. | 395/112 |
| 5,589,853 | 12/1996 | Fujiki | 345/156 |
| 5,602,567 | 2/1997 | Kanno | 345/11 |
| 5,606,344 | 2/1997 | Blaskey et al. | 345/2 |
| 5,617,565 | 4/1997 | Augenbraum et al. | 395/604 |
| 5,652,845 | 7/1997 | Arail et al. | 345/10 |

FOREIGN PATENT DOCUMENTS

| | | | |
|---|---|---|---|
| 4305026 | 8/1993 | Germany | G09G 1/02 |

*Primary Examiner*—Jeffery Brier
*Assistant Examiner*—Paul A. Bell
*Attorney, Agent, or Firm*—Brian F. Russell; Andrew J. Dillon

[57] ABSTRACT

A data processing system is disclosed, which includes a system unit, a display device for displaying data generated by the system unit, data communication means for communicating display data between the display device and the system unit, a peripheral device, and peripheral communication means for communicating data between the peripheral device and the system unit. In accordance with the present invention, data is communicated between the system unit and the peripheral device via the display device. Data is transferred between the display device and the peripheral device utilizing a wireless communication link, thereby eliminating the problems associated with electrical cables. In a preferred embodiment of the present invention, the wireless communication link includes a first transceiver means located in the display device and a second transceiver means located in a peripheral device. In a first embodiment, the first and second transceiver means comprise infrared transceivers. Utilizing infrared transceivers advantageously reduces undesirable radio frequency emissions. Alternatively, the first and second transceiver means may comprise a radio frequency transceiver.

21 Claims, 5 Drawing Sheets

DATA PROCESSING SYSTEM HAVING A WIRELESS COMMUNICATION LINK FOR DATA COMMUNICATION WITH A PERIPHERAL DEVICE

BACKGROUND OF THE INVENTION

1. Technical Field

The present invention relates in general to data processing system, and in particular, to a system for wireless communication between a processor unit and one or more peripheral devices.

2. Description of the Related Art

A conventional data processing system, such as a personal computer system, for example, typically includes a system unit having a processor sub-system such as a microprocessor, a display device, such as a cathode ray tube display or a liquid crystal display for displaying data generated by the system unit, display communication means for communicating data between the display device and the system unit, a peripheral device, such as a pointing device, a keyboard or a printer, and peripheral communication means for communicating data between the peripheral device and the system unit.

The display communication means and the peripheral communication means are generally implemented by electrical cables each containing plural signal lines. One problem with this arrangement is that the cables tend to become tangled, thereby hampering maintenance of the system. Another problem with this arrangement, which is particularly noticeable in "desk-top" computer systems is that the cables tend to occupy a large amount of otherwise useful space. A further problem with this arrangement is that the cables create large ground loops which tend to increase undesirable radio frequency emissions from the computer system. The above problems are exasperated by the addition of more peripheral devices, which each require their own individual cable connection to the system unit.

Consequently, it would be desirable to provide a system for wireless communication between a data processing system and peripheral devices.

SUMMARY OF THE INVENTION

It is therefore one object of the present invention to provide an improved data processing system.

It is another object of the present invention to provides an improved data processing system which provides wireless communication between a processor unit and a one or more peripheral devices.

The foregoing objects are achieved as is now described. A data processing system is disclosed, which includes a system unit, a display device for displaying data generated by the system unit, data communication means for communicating display data between the display device and the system unit, a peripheral device, and peripheral communication means for communicating data between the peripheral device and the system unit. In accordance with the present invention, data is communicated between the system unit and the peripheral device via the display device. Data is transferred between the display device and the peripheral device utilizing a wireless communication link, thereby eliminating the problems associated with electrical cables. In a preferred embodiment of the present invention, the wireless communication link includes a first transceiver means located in the display device and a second transceiver means located in a peripheral device. In a first embodiment, the first and second transceiver means comprise infrared transceivers. Utilizing infrared transceivers advantageously reduces undesirable radio frequency emissions. Alternatively, the first and second transceiver means may comprise radio frequency transceivers.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
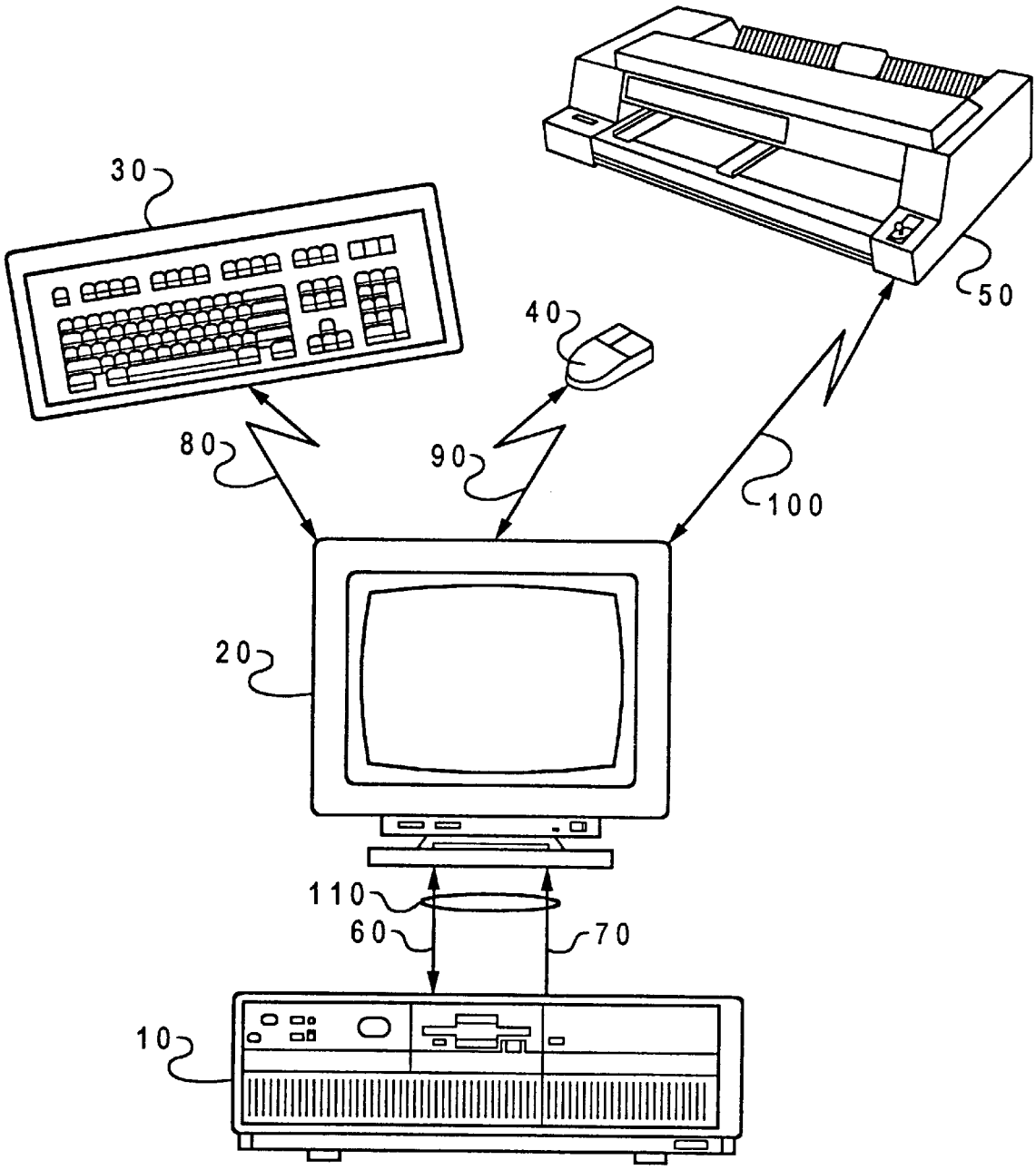
FIG. 1 is a block diagram of the data processing apparatus of the present invention.

With reference now to the figures and in particular with reference to FIG. 1, there is illustrated the data processing apparatus of the present invention, which includes a processor system unit 10, a display device 20, and peripheral devices including a printer 50, a pointing device 40, and a keyboard 30. Display device 20 may be based on any one of a number of different display technologies such as, for example, cathode ray tube display technology or liquid crystal display technology. Pointing device 40 may be a mouse, tablet, touch screen or the like. Display device 20 is connected to system unit 10 by an interface cable 110. Interface cable 110 includes Red (R), Green (G), and Blue (B) video signal lines and horizontal (H) and vertical (V) synchronization (sync) signal lines collectively represented by 70, together with a bidirectional serial data communication channel (C) 60. Keyboard 30 and mouse 40 each have an infrared transceiver (not shown). Printer 50 has an RF transceiver (not shown). Data transfer between display device 20 and each of printer 50, mouse 40, and keyboard 30 is facilitated by wireless communication links 100, 90, and 80, respectively.

Figure 2:
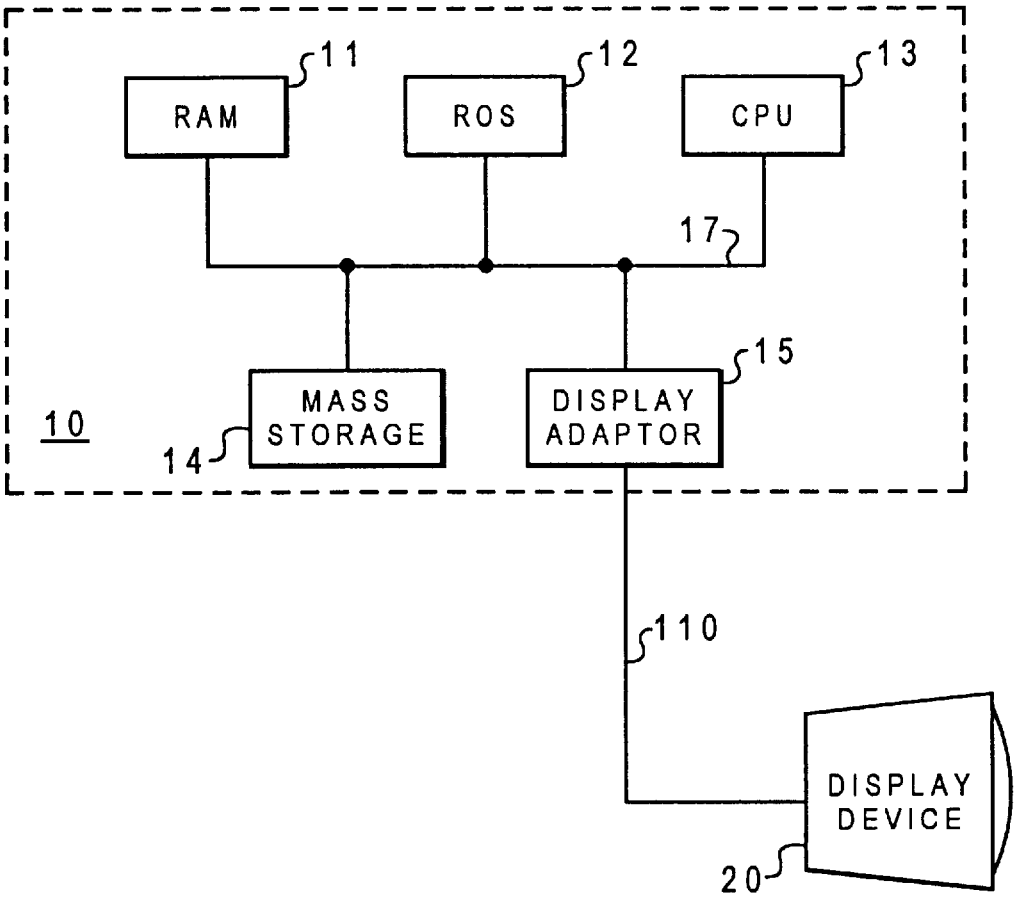
FIG. 2 is a block diagram of a system unit of the data processing apparatus depicted in FIG. 1.
Figure 3:
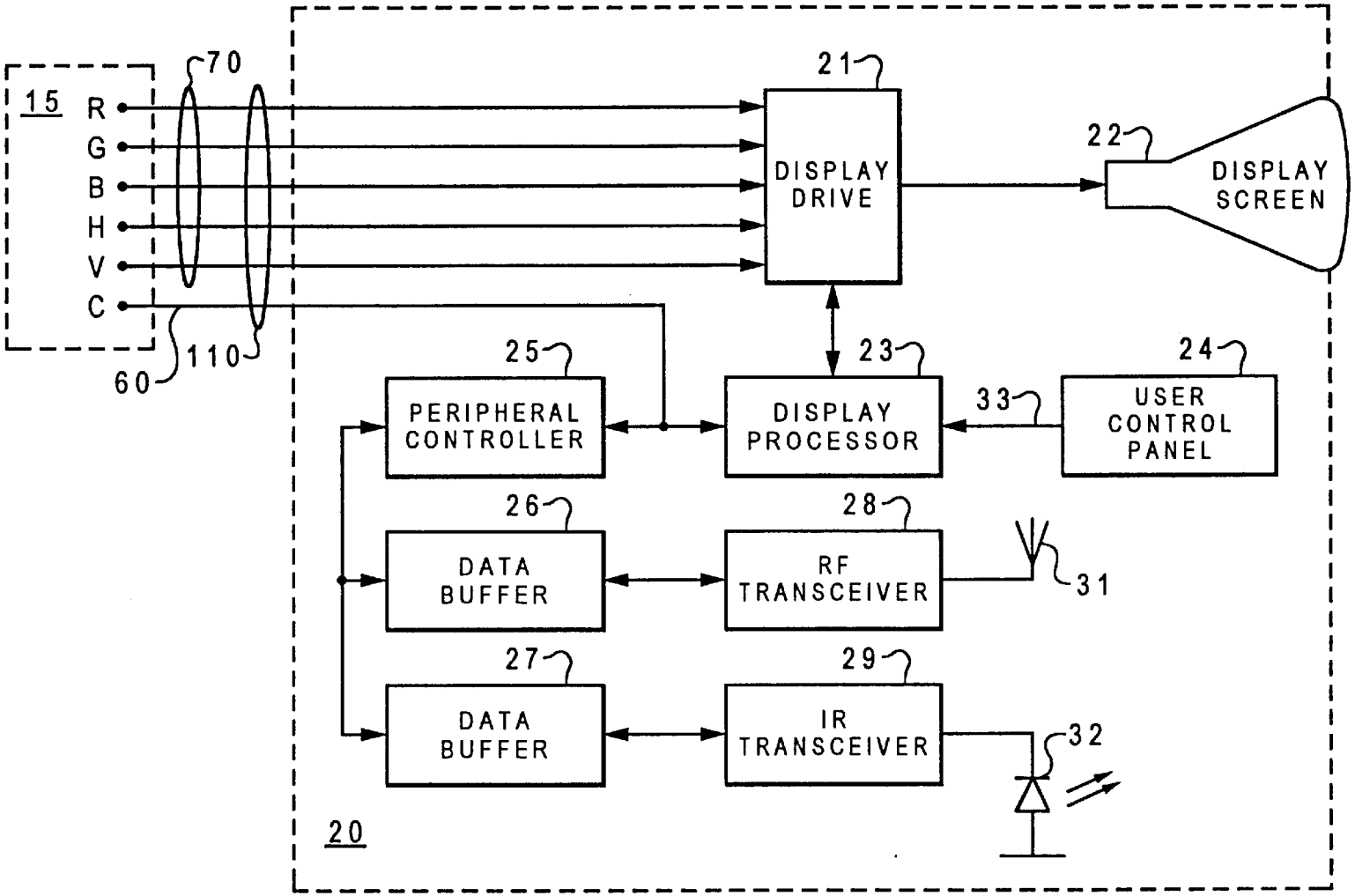
FIG. 3 is a block diagram of a display device of the data processing apparatus.

Referring now to FIG. 2, system unit 10 includes a random access memory (RAM) 11, a read only store (ROS) 12, a central processing unit (CPU) 13, a display adaptor 15, and a mass storage device 14 such as a hard disk drive or tape streamer, for example, all interconnected by a bus architecture 17. In operation, CPU 13 processes data stored in a combination of RAM 11 and mass storage device 14 under the control of computer program code stored in a combination of ROS 22, RAM 11, and mass storage device 14. Bus architecture 17 coordinates data transfer between adaptor 15, RAM 11, ROS 12, CPU 13, storage device 14. Adaptor 15 is connected, via interface cable 110, to display device 20. In operation, adaptor 15 translates output data from system unit 10 into R, G and B video signals, and H and V sync signals for configuring display device 20 to generate a visual data output. As illustrated in FIG. 3, the R, G, B, H and V signals are communicated from adaptor 15 to display device 20 via the R, G, B, H, and V lines 70 of interface cable 110. In addition, adaptor 15 communicates display control data between system unit 10 and display device 20 along a serial data channel 60 of interface cable 110. Adaptor 15 also permits data and instructions to be manually entered into system unit 10 from keyboard 30 and pointing device 40 via wireless links 80 and 90, display device 20 and serial data channel 60. Furthermore, adaptor 15 allows data and instructions to be sent from system unit 10 to printer 50 via wire-less link 100, display device 20, and serial data channel 60.

Referring now to FIG. 3, display device 20 comprises a display screen 22 connected to display drive circuitry 21. Display screen 22 may be a cathode ray tube or a liquid crystal display panel, for example. A display processor 23 is connected to drive circuitry 21. Display processor 23 may be at least partially implemented by hard-wired logic, by a microprocessor configured by computer program microcode, or by a combination of the two. A user control panel 24 is provided on the front of display device 20. Control panel 24 includes a plurality of manual operable switches connected to display processor 23.

In operation, drive circuitry 21 drives display screen 22 to generate a picture as a function of video signals R, G and B and sync signals H and V supplied by adaptor 15 via lines 70 of interface cable 110. The signal lines of interface cable 110 terminate at the end remote from display device 20 in a connector (not shown) for detachably connecting signal lines R, G, B, H, V, and C to adaptor 15. For compatibility, the connector is preferably a 15 pin D-type connector although other connectors may be used.

Display processor 23 is configured to control the output of drive circuitry 21 to display screen 22 as a function of preprogrammed display mode data and inputs from user control 24. The display mode data includes sets of preset image parameter values each corresponding to a different popular display mode such as, for example, 1024×768 pixels, 640×480 pixels, or 1280×1024 pixels. Each set of image display parameter values configures drive circuitry 21 to operate display screen 22 in a different display mode. Each set of display parameter values may include, for example, values determining height, vertical centering, width, horizontal centering, brightness, and color point. The image parameter values are selected by display processor 23 in response to mode information from adaptor 15. The mode information is delivered from adaptor 15 to display processor 23 via serial data channel 60. Display processor 23 processes the selected image parameter values to generate control levels in drive circuitry 21.

As aforementioned, adaptor 15 can send and receive control data from display device 20 via serial data channel 60. Initially, system unit 10 sends, via adaptor 15 and data channel 60, an interrogation code to display device 20. The interrogation code instructs display processor 23 to output on data channel 60 identification data to adaptor 15. The identification data identifies display device 20 to system unit 10. In particular, the identification data specifies to system unit 10 the operating parameters of display device 20. The operating parameters tell system unit 10 how to drive display device 20. The operating parameters may include, for example, maximum and minimum sync frequencies acceptable to display device 20. Furthermore, interrogation codes may be sent to display device 20 from system unit 10 via interface cable 110 when display device 20 is in use to monitor, for example, voltage levels in drive circuitry 21.

A user may also manually adjust the control levels controlling picture geometry, brightness, and color point via the user control panel 24. User control panel 24 may, for example, include a set of up/down control keys for each of image height, centering, width, brightness and contrast.

The control keys connected to key-pad interrupt inputs 33 to display processor 23. When, for example, the width up key is depressed, user control panel 24 issues a corresponding interrupt to display processor 23. The source of the interrupt is determined by display processor 23 via an interrupt polling routine. In response to the interrupt from the width key, display processor 23 progressively increases the corresponding analog control level sent to drive circuitry 21. The width of the image progressively increases. When the desired width is reached, the user releases the key. The removal of the interrupt is detected by display processor 23, and the digital value setting the width control level is retained. The height, centering, brightness and contrast setting can be adjusted by the user in similar fashion. User control panel 24 preferably further includes a store key. When the user depresses the store key, an interrupt is produced to which display processor 23 responds by storing in memory parameter values corresponding the current settings of its outputs as a preferred display format. The user can thus program into display 20 specific display image parameters according to personal preference. In addition, system unit 10 may send to display device 20 instruction codes via adaptor 15 and communication channel 60. The instruction codes cause display processor 23 to perform the same functions as those provided by user control panel 24. This enables the output of display device 20 to be adjusted remotely under the control of computer software running in system unit 10.

Display device 20 further includes a peripheral controller 25 connected to serial data channel 60. Controller 25 may be at least partially implemented by hard-wired logic, by a microprocessor configured by computer program microcode, or by a combination of the two. A radio frequency (RF) transceiver 28 is connected to controller 25 via a data buffer 26. Controller 25 is also connected, via a data buffer 27 to an infrared (IR) transceiver 29. Buffers 26 and 27 temporarily hold data being communicated between display device 20 and any of peripherals 30, 40 and 50 in case of a transmission error or a transmissions conflict between two or more peripherals. If an error or conflict is detected, data in the relevant buffer is resent. RF transceiver 28 is connected to an antenna 31. Similarly, IR transceiver 29 is connected by an IR emitter/detector shown generally by light emitting diode 32. Antenna 31 and emitter/detector 32 are both preferably, although not necessarily, internal to display device 20. Controller 25 includes a multiplexing means (not shown) for selectively connecting one of buffers 26 and 27 to serial data channel 60. Serial data channel 60 is switchable between controller 25 and processor 23.

As aforementioned, at initial power on, adaptor 15 of system unit 10 sends display device 20 an interrogation code to which processor 23 responds by returning identification data to adaptor 15 via serial data channel 60. However, the interrogation code sent by adaptor 15 is also detected by controller 25. On detection of the interrogation code from adaptor 15, controller 25 broadcasts a general interrogation code to peripheral devices 30, 40, 50 via transceivers 28 and 29. Any of the peripheral devices 30, 40, 50 which are powered on respond to the general interrogation code by causing their transceiver to transmit to display device 20 an acknowledgement code followed by a physical address code. The physical address code of each peripheral device may include, for example, the manufacturers identifier for the peripheral device, the device type, and the serial number of the device. In display device 20, controller 25 assigns a different logical address to each physical address received from the peripheral devices. After processor 23 has sent the display identification data to system unit 10, controller 25 takes over serial data channel 60 and sends each assigned logical address to system unit 10. Controller 25 also transmits each assigned logical address back to the relevant peripheral device. At regular intervals, display device 20 re-broadcasts the general interrogation code to allow detection of any new peripherals brought on-line. Peripheral devices assigned a logical address by display device 20 do not however respond to such subsequent broadcasts. Controller 25 is configured to poll, at regular intervals, each of peripherals 30, 40 and 50 to determine the status of peripherals 30, 40, and 50. Possible responses to the polling include, for example, ready to transmit data; ready to receive data; or, in the case of printer 50, out of paper. If a selected one of peripherals 30, 40 or 50 does not respond to a preset number of polls, ten polls for example, controller 25 is configured to assume that the selected peripheral has gone off-line. System unit 10 communicates with peripheral devices 30, 40 and 50 via display device 20 using the assigned logical addresses only. Each of peripheral devices 30, 40 and 50 includes transmission collision detection means to prevent two or more of peripheral devices 30, 40 and 50 from simultaneously transmitting data to display device 20.

When a key is depressed on keyboard 30, the transceiver in keyboard 30 transmits a corresponding input code to IR transceiver 29 in display device 20. The received input code is read into buffer 27. Controller 25 detects the received input code in buffer 27 and sends it to adaptor 15 in system unit 10 via serial data channel 60. In system unit 10, the input code is decoded to recover the character code corresponding to the key pressed.

Figure 4:
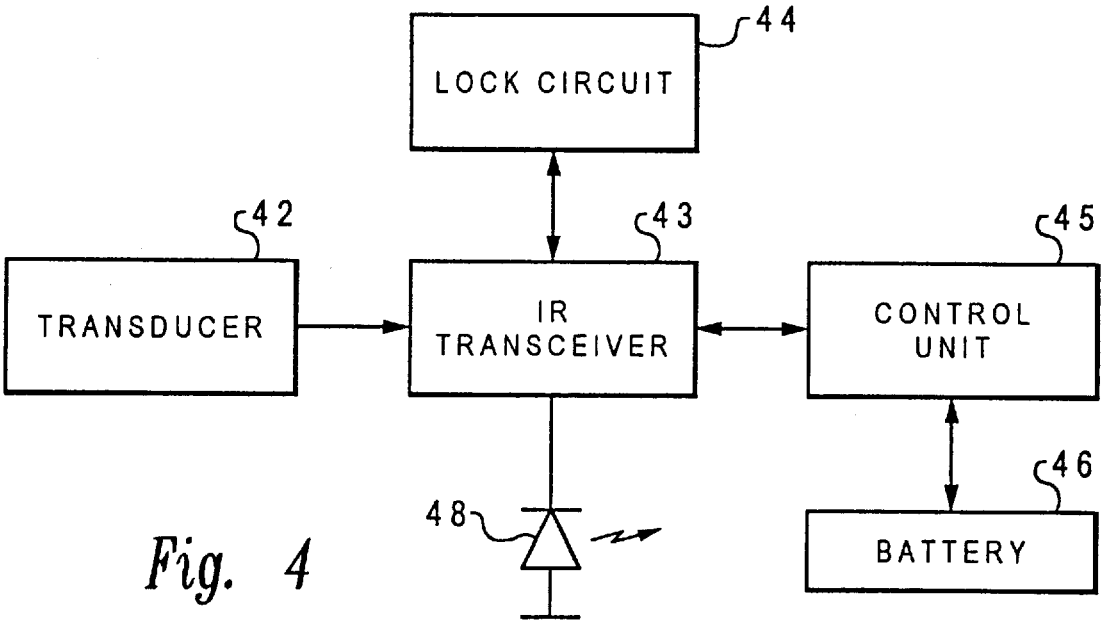
FIG. 4 is a block diagram of the mouse of the data processing apparatus illustrated in FIG. 1.

Referring now to FIG. 4, there is depicted a more detailed block diagram depiction of mouse 40. As illustrated, mouse 40 comprises a transducer 42 that detects mouse movement or the depression of a mouse button and generates a corresponding input code. In addition, mouse 40 includes an IR transceiver 43 which together with IR emitter/detector 48 is utilized to communicate information, including input codes, with display device 20. As is further illustrated in FIG. 4, mouse 40 includes a lock circuit 44, control unit 45, and battery 46, which are described in greater detail below. When mouse 40 is moved or clicked, IR transceiver 43 in mouse 40 transmits a corresponding input code to IR transceiver 29 in display device 20. The received input code is read into buffer 27. Controller 25 detects the received input code in buffer 27 and sends it to adaptor 15 in system unit 10 via serial data channel 60. In system unit 10, the input code is decoded to recover the corresponding cursor movement or button click.

When data is to be printed, system unit 10 causes adaptor 15 to send the data to be printed serially along data channel 60 to display device 20. Controller 23 loads the data to be printed from data channel 60 into buffer 26. The data to be printed is then transmitted from buffer 26 to printer 50 by RF transceiver 28. The transceiver in printer 50 detects the transmitted data to be printed. Printer 50 beings printing the data.

In a modification to the preferred embodiment of the present invention hereinbefore described, each of peripheral devices 30, 40 and 50 includes a lock circuit. Each lock circuit enables or disables communication between the host peripheral device and system unit 10 via display device 20. Communication between system unit 10 and any of peripheral devices 30, 40 and 50, is only permitted by display device 20 when the relevant lock circuit is unlocked. The lock circuit is unlocked by a preset password transmitted by display device 20 and received by the host peripheral device.

In another modification to the preferred embodiment of the present invention hereinbefore described, controller 25 includes means for sending a warning to system unit 10 via serial data channel 60 in response to detection of data transmitted from an previously undetected peripheral device. This enables identification by system unit 10 of unauthorized equipment additions to the data processing system, and thus to the detection of a possible security violation.

In yet another modification to the preferred embodiment of the present invention, the transceiver in each of peripheral devices 30, 40 and 50 includes a control unit having a battery power source. The control unit is configured to turn the host peripheral device on or off on detection of an appropriately addressed enabling or disabling signal from controller 25 in display device 20. Controller 25 is configured to send the enabling signal or the disabling signal in response to instructions sent from system unit 10 via serial data channel 60. System unit 10 can therefore remotely turn on and off the peripheral devices via serial data channel 60, controller 25, the wireless communication links 80, 90 and 100, and the control units of peripheral devices 30, 40 and 50. In other words, system unit 10 can remotely provide power management of the other components of the data processing system via serial data channel 60. Furthermore, because the transceiver within peripheral devices 30, 40, and 50 includes a battery power source, each of peripheral devices 30, 40, and 50 can respond to the broadcast of a general interrogation code regardless of whether or not main power is supplied. Thus, provided battery power is maintained, each peripheral can be traced. This advantageously allows unauthorized removal of peripheral device from the data processing system to be detected. For example, a security station including one or more transceivers dedicated to broadcasting the general interrogation code may be located at all access points to a data processing site. Any peripheral device fitted with a battery powered transceiver passing through such an access point responds to reception of the general interrogation code by transmitting an acknowledgement. The acknowledgement is detected by the transceiver in the security station and an alarm is activated if the removal of the peripheral is determined to be unauthorized.

Figure 5:
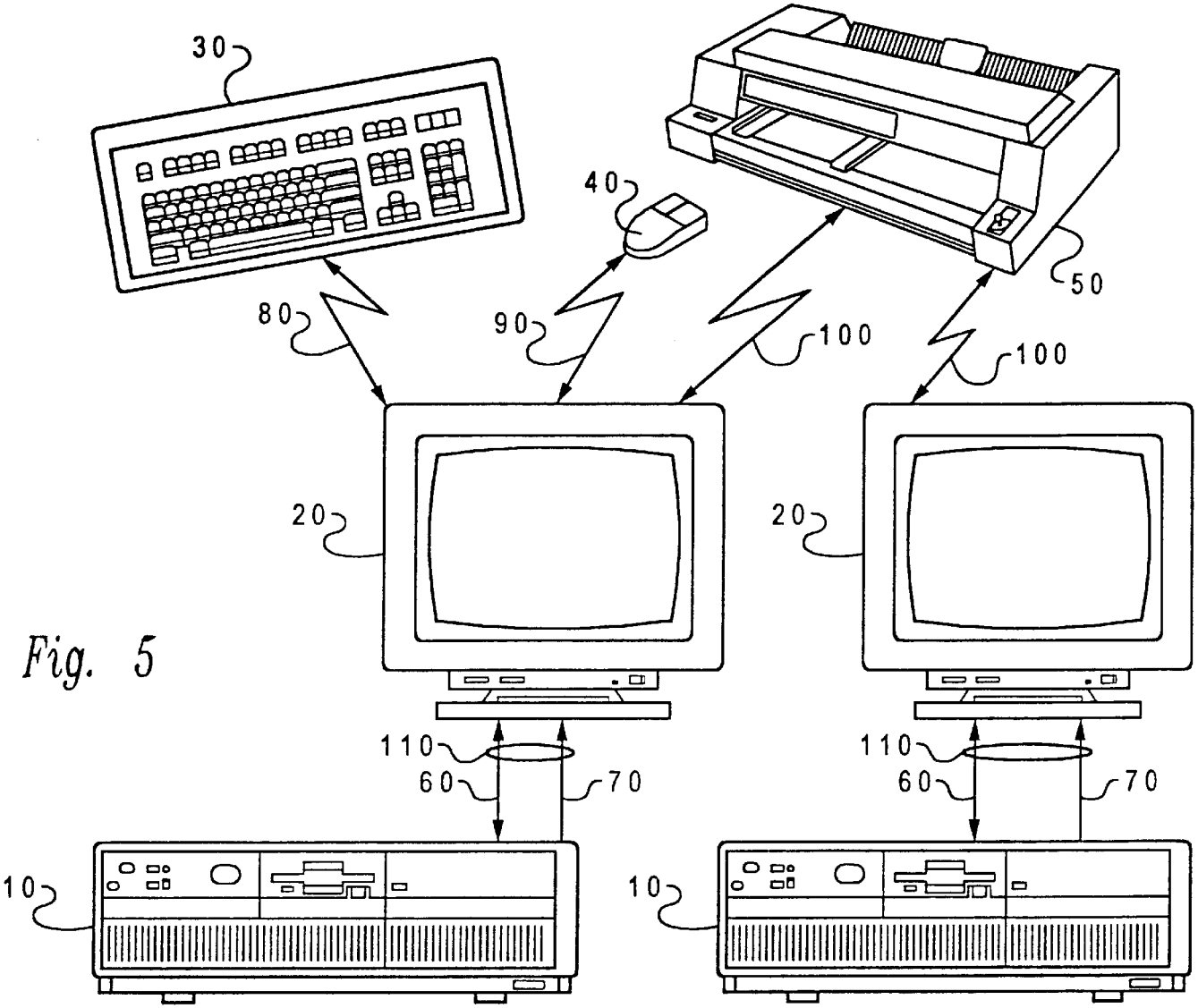
FIG. 5 is a block diagram of a data processing apparatus including a plurality of display devices that each communicate with a peripheral device in accordance with the present invention.

It will be appreciated that any of peripheral devices 30, 40 and 50 may be associated with more than one display device to allow resource sharing. For example, a single printer may be shared by more than one display device and attached system unit as illustrated in FIG. 5. It will be appreciated therefore, that a peripheral device may have more than one logical address.

Furthermore, it will be appreciated that, in some embodiments of the present invention, system unit 10 may send data to display device 20, or any one of peripheral devices 30, 40 and 50 in encrypted form for security purposes. In such embodiments, display device 10 and peripherals devices 30, 40 and 50 each include data encryption and decryption means. Encryption keys may changed periodically in such embodiments within an encrypted transmission by an initialization operation.

In the preferred embodiments of the present invention hereinbefore described, the data communicated between peripheral devices 30, 40 and 50 and system unit 10 is communicated between display 20 and system unit 10 via serial data channel 60 in interface cable 110. However, it will be appreciated that, in other embodiments of the present invention, such data may be communicated between display 20 and system unit 10 via a different data communication link. It will be further appreciated that, in some embodiments of the present invention, controller 25 may be adapted to accept more than one communication protocol from the peripheral devices and to reformat them into a single set of protocols for the communication link between display device 20 and system unit 10.

While the invention has been particularly shown and described with reference to a preferred embodiment, it will be understood by those skilled in the art that various changes in form and detail may be made therein without departing from the spirit and scope of the invention.

We claim:

1. A data processing system comprising:

a bus;

a processor coupled to said bus;

a first peripheral device, wherein said first peripheral device is a display device including a display driver that displays images in response to display signals and a display processor that controls the display of images by said display driver in response to instruction codes;

a plurality of peripheral devices other than said display device, each of said plurality of peripheral devices being identifiable by both a physical address and a logical address;

an adaptor connected to said bus and coupled to said display device, said adaptor communicating both display data and other peripheral data with said bus, said other peripheral data being associated with said plurality of peripheral devices other than said display device, wherein said adaptor converts display data received from said bus into display signals and transmits said display signals to said display device;

a communication channel connecting said adaptor and said display device, wherein said communication channel conveys, from said adaptor to said display device, said instruction codes and conveys said other peripheral data between said adaptor and said display device;

a plurality of wireless communication links, wherein each of said plurality of wireless communication links is capable of communicating the other peripheral data between a respective one of said plurality of peripheral devices other than said display device and said display device; and a peripheral controller, located within said display device, that assigns a different logical address to each respective peripheral device among said plurality of peripheral devices from which said peripheral controller receives a physical address in response to receipt by the peripheral device of an interrogation code from said peripheral controller, wherein said peripheral controller supplies each assigned logical address to both said adaptor and the peripheral device to which the logical address is assigned, and wherein said peripheral controller selectively couples a wireless communication link among said plurality of wireless communication links to said communication channel in response to a logical address specified in said other peripheral data.

2. The data processing system of claim 1, wherein each of said plurality of wireless communication links includes a first transceiver means located within said display device and a second transceiver means located in a corresponding one of said plurality of peripheral devices other than said display device.

3. The data processing system of claim 2, wherein each of said plurality of wireless communication links includes a buffer located within said display device for coupling said first transceiver means to said communication channel.

4. The data processing system of claim 2, wherein said first transceiver means includes an infrared transceiver and said second transceiver means, in at least one of said plurality of peripheral devices other than said display device, includes an infrared transceiver.

5. The data processing system of cl aim 2, wherein said first transceiver means includes a radio frequency transceiver and said second transceiver means, in at least one of said plurality of peripheral devices other than said display device, includes a radio frequency transceiver.

6. The data processing system of claim 2, wherein a second transceiver means in at least one of said plurality of wireless communication links includes a control unit having a battery power source, said control unit being configured to enable transmission of peripheral data by said second peripheral device in response to detecting an enabling signal from said display device and to disable transmission of peripheral data by said second peripheral device in response to detecting a disabling signal from said display device, said display device being configured to send enabling and disabling signals in response to receipt of instructions via said communication channel.

7. The data processing system of claim 1, wherein said plurality of peripheral devices other than said display device includes a pointing device and a keyboard.

8. The data processing system of claim 1, wherein a second peripheral device among said plurality of peripheral devices includes a lock circuit responsive to a password transmitted by said display device for enabling transmission of peripheral data from said second peripheral device to said display device.

9. The data processing system of claim 1, wherein said display device transmits said other peripheral data from said display device to a second peripheral device among said plurality of peripheral devices in a security-encrypted format.

10. The data processing system of claim 1, wherein said peripheral controller transmits a warning to said bus via said communication channel and said adaptor in response to detection of peripheral data transmitted from a previously undetected peripheral device.

11. The data processing system of claim 1, wherein said display device is a stand-alone monitor connected to said adaptor by an interface cable, and wherein said communication channel includes a serial data channel within said interface cable.

12. The data processing system of claim 1, and further comprising a plurality of system units each connected to a respective one of a plurality of display devices, wherein more than one of said plurality of display devices communicates with a second peripheral device among said plurality of peripheral devices.

13. The data processing system of claim 1, wherein each of said plurality of peripheral devices responds to receipt of an interrogation code from said peripheral controller by supplying a physical address only if the peripheral device does not have an assigned logical address.

14. A display device comprising:

a display communication means for communicating display signals between a data processing system and said display device;

a display screen;

a drive circuit for displaying an image within said display screen in response to said display signals;

a display processor that controls the display of images by said drive circuit in response to instruction codes;

a plurality of wireless communication links, wherein each of said plurality of wireless communication links is capable of communicating peripheral data between a respective one of a plurality of peripheral devices other than said display device and said display device;

a communication channel for communicating, between said display device and the data processing system, both said peripheral data and said instruction codes that control the display of said image; and a peripheral controller that assigns a different logical address to each respective peripheral device among said plurality of peripheral devices from which said peripheral controller receives a physical address in response to receipt by the peripheral device of an interrogation code from said peripheral controller, wherein said peripheral controller supplies each assigned logical address to both said data processing system and the peripheral device to which the logical address is assigned, and wherein said peripheral controller selectively couples a wireless communication link among said plurality of wireless communication links to said communication channel in response to a logical address specified in said other peripheral data.

15. The display device of claim 14, wherein said plurality of wireless communication links include an infrared transceiver.

16. The display device of claim 14, wherein said plurality of wireless communication links include a radio frequency transceiver.

17. The display device of claim 14, said communication channel comprising a serial data channel.

18. A method of transferring data in a data processing system including a system unit, a first peripheral device comprising a display device, and a plurality of other peripheral devices including a second peripheral device, wherein said system unit includes an adaptor coupled to a bus in said system unit, and wherein said display device has a plurality of wireless communication links that are each capable of communicating peripheral data between said display device and a respective one of said plurality of peripheral devices, said method comprising:

registering said plurality of peripheral devices with said data processing system, wherein registering includes:

broadcasting an interrogation code from said display device through said plurality of wireless communication links;

in response to receipt of said interrogation code by said plurality of peripheral devices, transmitting, via said plurality of wireless communication links, a unique physical address from each of said plurality of peripheral devices to said display device;

in response to receipt of physical addresses from said plurality of peripheral devices, assigning each of said Plurality of peripheral devices a unique logical address and transmitting, via said wireless communication links, each assigned logical address to the peripheral device to which the logical address is assigned; and transmitting each assigned logical address to said system unit;

communicating display signals between said adaptor and said display device;

in response to receipt of said display signals at said display device, displaying an image within said display device;

communicating peripheral data between said second peripheral device and said display device via a wireless communication link;

communicating, via a communication channel coupling said adaptor and said display device, both said peripheral data communicated between said display device and said second peripheral device and instruction codes that control the display of said image within said display device; and communicating said peripheral data between said adaptor and said bus.

19. The method of transferring data of claim 18, and further comprising the step of:

prior to communicating said peripheral data between said second peripheral device and said display device, converting said peripheral data into a security-encrypted format.

20. The method of transferring data of claim 18, and further comprising the step of:

enabling transmission of peripheral data from said second peripheral device to said display device by transmitting a password from said display device to said second peripheral device via said wireless communication link.

21. The method of claim 18, wherein transmitting a unique physical address from each of said plurality of peripheral devices to said display device comprises transmitting a unique physical address from a particular peripheral device to said display device only if said particular peripheral device has not be assigned a logical address.

* * * * *